US006349193B1

(12) United States Patent
Matayoshi

(10) Patent No.: US 6,349,193 B1
(45) Date of Patent: Feb. 19, 2002

(54) IMAGE FORMING APPARATUS HAVING ENHANCED IMAGE FORMATION SPEED AND INCREASED COPY CAPACITY

(75) Inventor: Moritoshi Matayoshi, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/521,605

(22) Filed: Mar. 9, 2000

(51) Int. Cl.[7] ..... G03G 15/00

(52) U.S. Cl. ..... 399/388; 271/9.01; 399/393

(58) Field of Search ..... 399/388, 381, 399/204, 195, 393, 392; 271/9.01, 9.05, 9.07

(56) References Cited

U.S. PATENT DOCUMENTS 5,573,234 A * 11/1996 Petocchi ..... 271/9.01
H21 H * 2/1986 Schieck ..... 399/367

FOREIGN PATENT DOCUMENTS

JP 56-39559 4/1981
JP 2-24673 * 1/1990

* cited by examiner

*Primary Examiner*—Quana M. Grainger
(74) *Attorney, Agent, or Firm*—Foley & Lardner

(57) ABSTRACT

An image forming apparatus of the present invention has a photosensitive drum for carrying an electrostatic latent image, an image forming section for forming the electrostatic latent image on the photosensitive drum, a developing unit for supplying a developing agent to the electrostatic latent image formed by the image forming section, a transfer charger for transferring a developing agent image which is developed by the developing unit to a sheet, supplying mechanism for supplying the sheet to the photosensitive drum, and a control section for allowing a plurality of electrostatic latent images to be formed at a time in a parallel sheet array on the photosensitive drum as required through an image forming mechanism, in which the supplying mechanism has a supplying section for holding sheets in a parallel array as required and first and second supply sections for allowing the sheets which are held in a parallel array to be picked up in units of one sheet in a parallel array at a time and supplying these parallel sheets to the photosensitive drum.

8 Claims, 5 Drawing Sheets

IMAGE FORMING APPARATUS HAVING ENHANCED IMAGE FORMATION SPEED AND INCREASED COPY CAPACITY

BACKGROUND OF THE INVENTION

The present invention relates to an image forming apparatus applied, for example, as an electrophoto-graphic copier. The electrophotographic copier forms an electrostatic latent image on a photosensitive drum, supplies a developing agent to the electrostatic latent image to develop the image and transfers the developing agent image to a sheet as a transfer medium.

In the prior art, sheets are supplied to a photosensitive drum only on a one-by-one basis and, in the case where, for example, a large quantity of copies are taken for a shorter time, there has been left no other way but to increase a copying speed. For this reason, the copier becomes larger in size and the noise becomes louder.

Further, in the case where sheets of smaller size are continuously supplied to the copier and a larger quantity of copies is taken, the photosensitive drum is deteriorated at a surface area corresponding to the sheet size. In the case where a larger quantity of copies is taken with a continuous supply of smaller-size sheets and then a copy is taken with the use of a maximum-size sheet, a defective image results.

BRIEF SUMMARY OF THE INVENTION

The present invention is achieved with the above-mentioned situation in view and it is accordingly the object of the present invention to provide an image forming apparatus which can take a large quantity of copies for a shorter time and obtain a better quantity of image even in the case where, after a larger quantity of copies has been taken, a copy is taken with the supply of a sheet of larger size.

An image forming apparatus of the present invention comprises an image carrier for carrying an electrostatic latent image, image forming means for forming the electrostatic latent image on the image carrier, developing means for supplying a developing agent to the electrostatic latent image formed by the image forming means and developing the latent image, transfer means for transferring the developing agent image developed by the developing means to be transferred to a transfer medium, supplying means for supplying the transfer medium to the image carrier, and control means for allowing a plurality of electrostatic latent images to be formed at a time in a parallel array on the image carrier as required through the image forming means, wherein the supplying means has a holding section for holding the transfer medium in a parallel sheet array as required and first and second supply sections for allowing the transfer medium which is held in a parallel sheet array in the holding section to be picked up in units of one sheet in a parallel way at a time and supplying these parallel sheets to the image carrier.

An image forming apparatus of the present invention comprises an image carrier for carrying an electrostatic latent image, image forming means for forming the electrostatic latent image on the image carrier, developing means for supplying a developing agent to the electrostatic latent image formed by the image forming means and developing the latent image, transfer means for allowing a developing agent image which is developed by the developing means to be transferred to a transfer medium, supplying means for supplying the transfer medium to the image carrier, and control means for allowing a plurality of electrostatic latent images to be formed in a parallel array at a time as required on the image carrier through the image forming means wherein the supplying means has a holding section for, when a plurality of electrostatic latent images are formed in a parallel array at a time, holding the transfer medium in a parallel sheet array and, when the electrostatic latent image is formed as a single image, holding the transfer medium in a single individual form, first and second supply sections for allowing the transfer medium which is held in a parallel sheet array in the holding section to be picked up in units of one sheet at a time and supplying these parallel sheets to the image carrier and a third supply section for allowing the transfer medium which is held in a single individual form in the holding section to be picked up in a one-by-one way and supplying the single individual sheet to the image carrier.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The embodiments of the present invention will be explained below with reference to the accompanying drawing.

Figure 1:
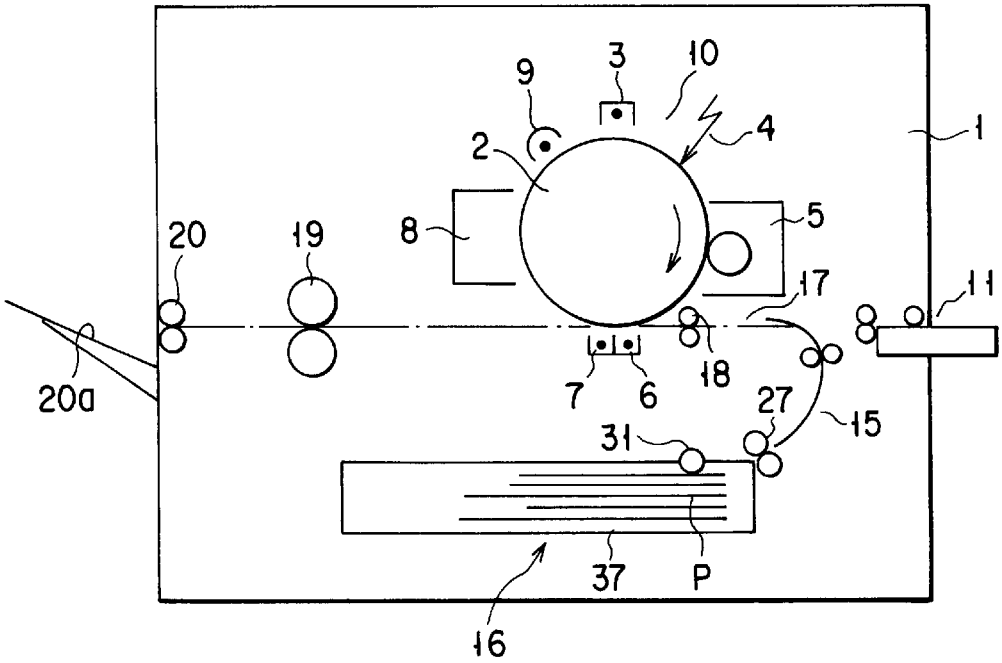
FIG. 1 is a diagrammatic view showing an electrophotographic copier according to a first embodiment of the present invention.

FIG. 1 is a diagrammatic view showing an electrophotographic copier as an image forming apparatus according to a first embodiment of the present invention.

Reference numeral 1 in FIG. 1 shows a body of a copier and a photosensitive drum 2 is rotatably provided at a substantially center area within the body of the copier 1 and serves as an image carrier for carrying an image thereon. A charger 3, light exposure section 4, developing unit 5, transfer and separation chargers 6 and 7, cleaning unit 8 and discharger 9 are arranged around the photosensitive drum 2 along a rotation direction of the photosensitive drum 2, thus constituting an image forming mechanism 10.

The charger 3 charges the surface of the photosensitive drum 2 to a predetermined potential and the light exposure section 4 forms a toner image corresponding to a document image. The developing unit 5 supplies a toner as a developing agent to an electrostatic latent image on the photosensitive drum 2 and develops it.

The transfer charger 6 transfers the toner image on the photosensitive drum 2 to a sheet as a transfer medium and the separation charger 7 separates a toner image-transferred sheet from the photosensitive drum 2.

The cleaning unit 8 removes a remaining toner on the photosensitive drum 2 and the discharger 9 removes a surface potential of the photosensitive drum 2.

At a lower side within the copier body 1, a sheet supply mechanism 16 is provided as will be set out in more detail below. A sheet picked up from the supply mechanism 16 is fed via a sheet supply path 15 to a conveying path 17. At the conveying path 17, a register roller 18, transfer and separation chargers 6, 7, fixing roller 19 and sheet discharge roller 20 are sequentially arranged, the register roller serving as an aligning means for arraying a sheet along a conveying direction.

At a time of forming an image, the surface of the photosensitive drum 2 is charged by the charger 3 and an electrostatic latent image corresponding to a document image is formed by the light exposure section 4 on the charged surface of the photosensitive drum 2. This electrostatic latent image is sent to the developing agent 5 by the rotation of the photosensitive drum 2 and developed by supplying a toner from the developing unit 5 to provide a toner image.

At this time, on the other hand, a sheet is taken out by the sheet supply mechanism 16. This sheet is sent via the sheet supply path 15 onto the conveying path 17 and, after being aligned by the register roller 18, sent between the photosensitive drum 2 and the transfer charger 6. Under the action of the transfer charger 6, the toner image on the photosensitive drum 2 is transferred to the sheet P. Under the action of the separating charger 9 the toner image-transferred sheet P is separated from the photosensitive drum 2 and conveyed. This sheet P is sent to the fixing roller 19 where its transferred toner image is fixed to the sheet P. After this fixing step, the sheet is discharged onto a sheet discharge tray 20*a*.

Figure 2:
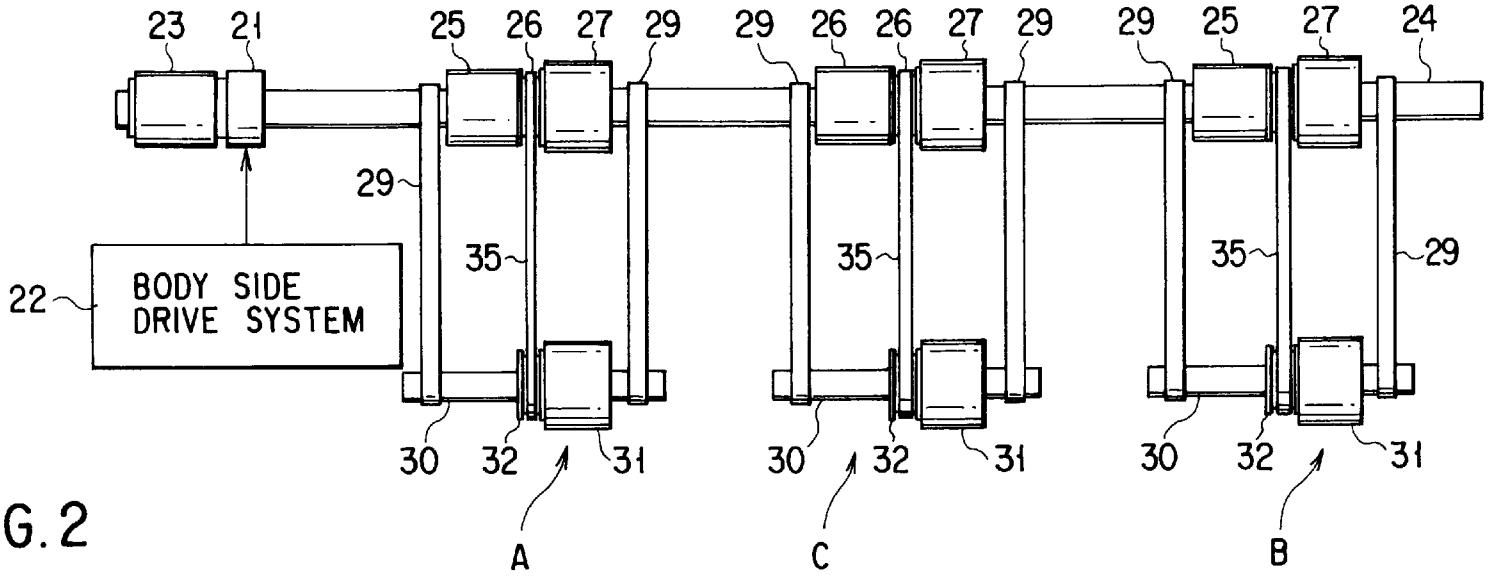
FIG. 2 is a plan view showing a sheet supply mechanism.

FIG. 2 is a plan view showing the sheet supply mechanism 16 for supplying the above-mentioned sheet.

This sheet supply mechanism 16 has first, second and third supply section A, B, and C, respectively. The first, second and third supply sections A, B and C are mounted at predetermined intervals on a shaft 24.

The first supply section A has an electromagnetic clutch 25 and sheet supply roller 27 mounted on the shaft 24 and a pulley 26 is incorporated in the electromagnetic clutch 25. A claw section (not shown) is projected at a side surface of the pulley 26 and, through this claw section, the pulley 26 and sheet supply roller 27 are formed as an integral unit. Further, the first supply section A has one pair of swinging arms 27, 29 mounted on the shaft 24 and, between the swinging end portions, a pick-up roller 31 and pulley 32 are mounted through a support shaft 30. A claw, not shown, is projected at a side surface area of the pulley 32 and, through the claw, the pulley 32 and pick-up roller 31 are formed as an integral unit. A power transmission belt is trained between the pulley 26 and the pulley 32.

Incidentally, the second and third supply sections B and C are constructed in the same way as the first supply section A and any further explanation of these is omitted with the same reference numerals applied to corresponding parts.

An electromagnetic clutch 23 is connected to one end portion of the above-mentioned shaft 24 and a driven gear 21 is incorporated in the electromagnetic clutch 23 and a power is transmitted from a drive system 22 on the copier body side to the driven gear 23. With the electromagnetic clutch 23 ON, the driven gear 21 is attracted to the electromagnetic clutch 23 to allow a drive force to be transmitted to the shaft 24.

Figure 3:
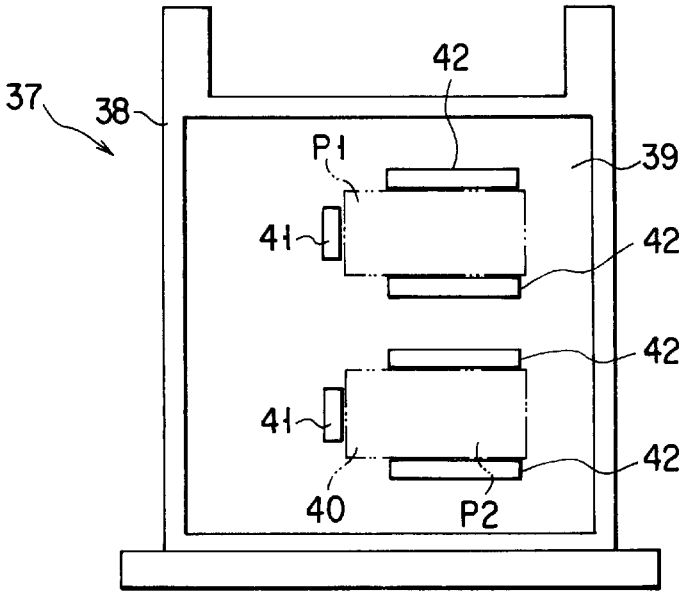
FIG. 3 is a plan view showing sheet supply cassettes.

FIG. 3 shows a sheet supply cassette 37 serving as a sheet holding section of the sheet supply mechanism 16.

Reference numeral 38 in FIG. 3 shows a cassette body. First and second sheet holding sections 39 and 40 are provided within the cassette body 38. The first and second sheet holding sections 39 and 40, each, comprise a Back plate 41 for supporting a Back end section of sheets and side walls for guiding both side surface sections of the sheets. Copying sheets P1, P2 are arranged in a parallel array in a manner to be held, in a stacked state, between the side walls 42 and 42. The size of the copying sheets is set to be below one-fourth (¼) the maximum sheet size used.

The side walls 42, 42 are removably mounted and removed at a time of supplying a sheet in a normal one-sheet supply mode.

The above-mentioned first sheet supply section A is set opposite to the first sheet holding section 39 of the sheet supply cassette 11 with the pick-up roller 31 set in contact with the sheet P1 and the second sheet supply section B is set opposite to the second sheet holding section 40 of the sheet supply cassette 11 with the pick-up roller 31 set in contact with the sheet P2.

Figure 4:
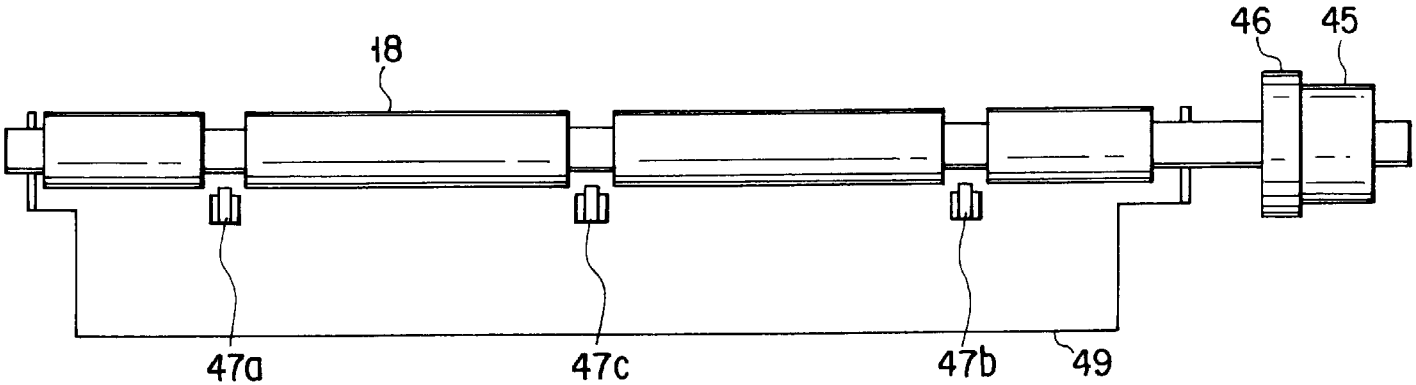
FIG. 4 is a plan view showing a register roller.

FIG. 4 is a plan view showing the above-mentioned register roller 18.

To one end portion of a shaft 18*a* of the register roller 18 an electromagnetic roller 45 is mounted and a pulley 46 is incorporated in the electromagnetic clutch 45. Further, first to third sensors 47*a* to 47*c* are arranged at predetermined intervals over an axial direction of the register roller 18 and operated by being pushed by the leading edge of a copying sheet sent into the sheet introducing side of the register roller 18 from an arrow direction.

A guide plate 49 is provided at the sheet introducing side of the register roller 18 to guide the copying sheet to the register roller 18.

Figure 5:
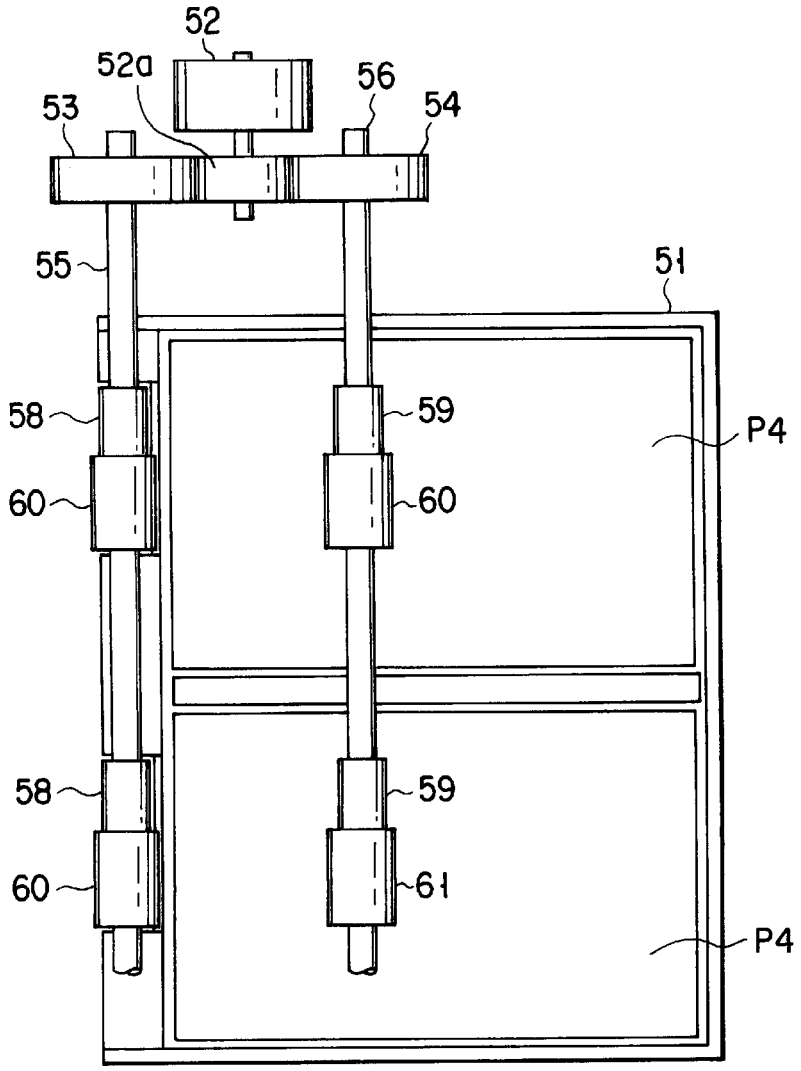
FIG. 5 is a plan view showing a post card supply mechanism.
Figure 6:
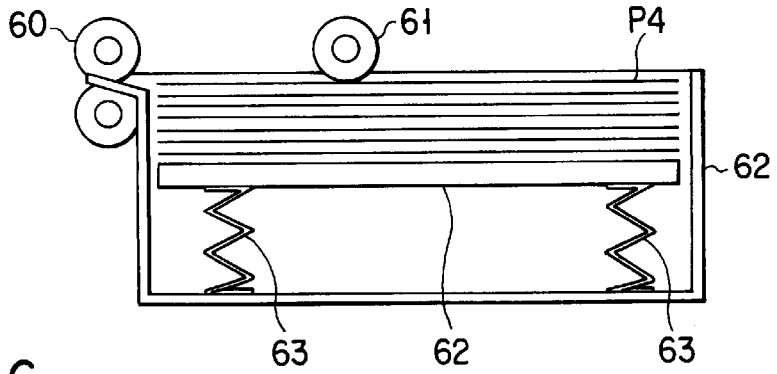
FIG. 6 is a side cross-sectional view showing the post card supply mechanism.

FIG. 5 is a plan view showing a post card unit 51 set at a manual sheet supply section 11 of the copier body 1 and FIG. 6 shows a side cross-sectional view.

Reference numeral 52 in FIG. 5 shows a drive motor and, to a drive shaft of the drive motor, first and second gears 53 and 54 are connected through a gear 52a. The first and second gears 53 and 54 are connected to one-end side portions of the first and second shafts 55 and 56.

A pair of electromagnetic clutches 58, 58 are mounted on the first shaft 55 at a predetermined interval and sheet supply rollers 60 are incorporated in the electromagnetic clutches 58, 58. Although the sheet supply roller 60 is normally rotated in an idle state, if the electromagnetic clutch 58 is turned ON, a drive force is transmitted to the sheet supply roller 60.

A pair of electromagnetic clutches 59, 59 are mounted on the second shaft 56 and pick-up rollers 61 are incorporated in the electromagnetic clutches 59, 59. Although the pick-up roller 61 is normally rotated in an idle state, if the electromagnetic clutch 59 is turned ON, a post card P4 is picked up and supplied. The post cards P4 and P4 are held in the card trays 62 and springs 63, 63 are normally urged toward the pick-up roller 61.

Figure 7:
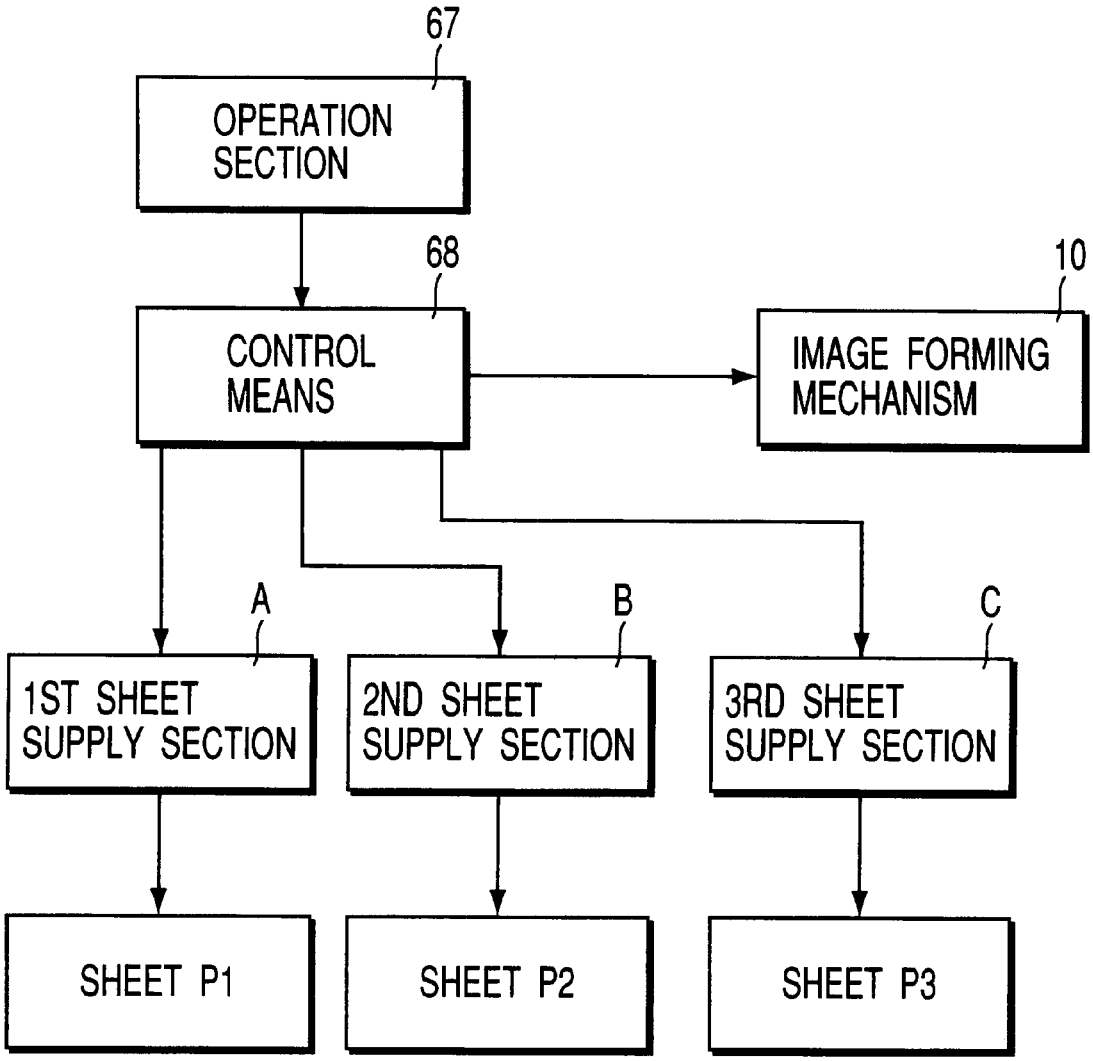
FIG. 7 is a block diagram showing a drive control system of the sheet supply mechanism.

FIG. 7 is a block diagram showing a drive control system of the above-mentioned sheet supply mechanism 16.

Reference numeral 67 in FIG. 7 shows an operation section by which an image formation is set in a normal image formation mode or in a two-sheets-at-a-time mode. To this operation section 67 a control means 68 is connected via a signal path. An image forming mechanism 10 and first to third sheet supply sections A to B are connected to the control means 68 through a control circuit. With the normal image formation mode set, the control means 68 allows one image to be formed on the photosensitive drum 2 through the image forming mechanism 10 and a sheet P to be supplied through a third sheet supply section C.

Further, with the image formation set to a two-sheets-at-a-time mode, the control means 68 allows two images to be formed in a parallel array on the photo-sensitive drum 1, through the image forming mechanism 10, over the axial direction of the drum 1 and the first and second sheet supply sections A and B to be operated to supply the sheets P1, P2 at the same time.

Then an explanation will be given below of the case where two images are formed at a time in a parallel array on the photosensitive drum 2 through the image formation mechanism 10. Further, the electromagnetic clutches 25, 25 of the first and second sheet supply sections A, B in the sheet supply mechanism 16 are turned ON to cause the pulleys 26, 26 to be rotated. Through the rotation of the pulleys 26, 26, the sheet supply rollers 27, 27 are rotated and, through the power transmission belts 35, 35 and pulleys 32, 32, the pick-up rollers 31, 31 are rotated.

Through the rotation of the pick-up rollers 31, 31, the sheets P1, P2 are simultaneously picked up and these sheets are supplied in a parallel way through the rotation of the sheet supply rollers 27, 27.

The sheets P1 and P2 are conveyed toward the register roller 18 and, when arriving before the register roller 18, detected by the first and second sensors 47*a,* 47*b.* After a lapse of a predetermined time following the detection of the sheets P1, P2 by the first and second sensors, the electromagnetic clutch 45 is turned ON and a drive force from a body's drive system is transmitted through the pulley 46. By doing so, the register roller 18 is rotated to send the sheets P1, P2 to the photosensitive drum 2 where corresponding developing agent images are simultaneously transferred to the sheets.

At the time of forming two images at a time, an odd number sheet is input as a copying sheet, only the electromagnetic clutch 25 of any one of the sheet supply sections A, B is turned ON and a final sheet is supplied as one sheet alone.

An explanation will be given below of the case where an image is formed in a normal one-by-one sheet supply mode.

In this case, a normal one-sheet supply cassette is mounted in place of a sheet supply cassette 37 and the electromagnetic clutch 25 only of the third sheet supply section C is turned ON and a sheet P3 is supplied as only one sheet.

The sheet P3 thus supplied is detected before the register roller 18 by the third sensor 47*c* and arrayed there and sent to the photosensitive drum 2.

Although, in the first embodiment, the electromagnetic clutch is employed, the present invention is not restricted thereto and an electromagnetic spring clutch may be used.

Figure 8:
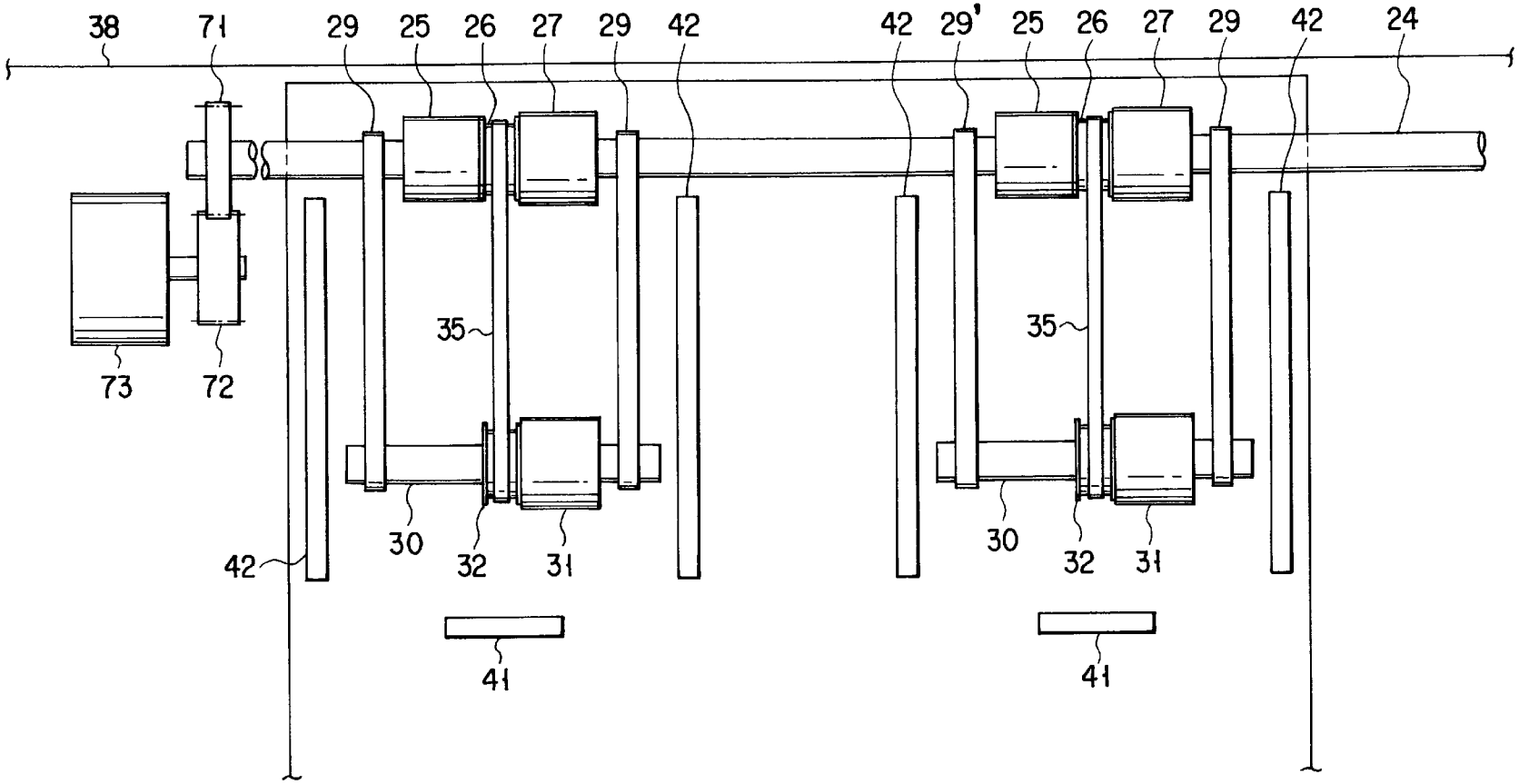
FIG. 8 is a plan view showing a sheet supply mechanism in a second embodiment of the present invention.

FIG. 8 shows a sheet supply mechanism in a second embodiment of the present invention.

The same reference numerals are employed to designate parts or elements corresponding to those shown in the first embodiment and any further explanation is omitted.

Although, in the above-mentioned first embodiment, a drive force has been explained as being supplied from a drive system on the copier body side, the second embodiment is such that a drive motor 73 is connected through gears 71, 72 to a one-end portion of a shaft 24 with first and second sheet supply sections A and B mounted thereon in which case the first and second sheet supply section A and B are driven by a drive force of the drive motor 73.

As set out above, the present invention includes the control means for allowing a developing agent image to be formed as a plurality of such images in a parallel array, as required, on the image carrier through the image forming means, a holding section for holding the transfer medium in a parallel sheet array, and supply means for allowing the transfer medium which is held in a parallel sheet array in the holding section to be picked up through the first and second supplying sections and to be supplied in a parallel sheet array to the image carrier. It is, therefore, possible to enhance an image formation speed and obtain an increased number of copies. As a result, it is possible to obviate the need for increasing the size of the image forming apparatus and to prevent noise, etc., from being produced.

Even if copies of greater size are taken after many copies of smaller size are taken, it is possible to obtain an excellent quality image.

Further, in the case where the copy number is set as an odd number, only one of the first and second supplying sections is operated to allow a final sheet to be supplied as a single sheet only.

Further, at the time of forming an image in a normal one-by-one sheet supply mode, a transfer medium is picked up through the third supply section and supplied, so that the present invention can handle any situation in which an image is formed in normal one-by-one sheet supply mode and in a two-sheets-at-a-time supply mode.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

an image carrier for carrying an electrostatic latent image;

image forming means for forming the electrostatic latent image on the image carrier;

developing means for supplying a developing agent onto the electrostatic latent image formed by the image forming means and developing the latent image;

transfer means for transferring a developing agent image developed by the developing means to a transfer medium;

control means for allowing a plurality of electrostatic latent images to be formed at a time in a parallel manner on the image carrier through the image forming means as required;

supplying means including a holding section for holding transfer mediums side by side as required, and a first supplying section and a second supplying section for allowing the transfer mediums, which are held in the holding section side by side, to be picked up in a parallel way at a time and supplying these transfer mediums to the image carrier; and an operating section for setting a number of transfer mediums to be supplied by the supplying means, wherein when an odd number is set, only one of the first and second supply sections of the supplying means is operated to allow a final transfer medium to be taken out.

2. An image forming apparatus according to claim 1, wherein the holding section holds the transfer medium in a parallel array, the sheet size of the transfer medium being below one-fourth (¼) the maximum sheet size of the holding section.

3. An image forming apparatus according to claim 1, further comprising an aligning means for arraying the sheet sent toward the image carrier; and a plurality of detecting means arranged at predetermined intervals at a sheet introducing side of the aligning means in a direction perpendicular to a conveying direction of the sheet to detect those sheets conveyed in a parallel array, wherein, after these detecting means detect the sheets conveyed in a parallel array, the aligning means is operated to send the sheets to the image carrier.

4. An image forming apparatus according to claim 1, wherein the holding section has a guide member for guiding each side surface and back surface of the transfer medium held in a parallel sheet array.

5. An image forming apparatus according to claim 4, wherein the guide member is detachably mounted at the holding section.

6. An image forming apparatus comprising:

an image carrier for carrying an electrostatic latent image;

image forming means for forming the electrostatic latent image on the image carrier;

developing means for supplying a developing agent onto the electrostatic latent image formed by the image forming means and developing the latent image;

transfer means for transferring a developing agent image developed by the developing means to a transfer medium;

control means for allowing a plurality of electrostatic latent images to be formed at a time in a parallel manner on the image carrier through the image forming means as required;

supplying means including a holding section for holding transfer mediums side by side as required, and a first supplying section and a second supplying section for allowing the transfer mediums, which are held in the holding section side by side, to be picked up in a parallel way at a time and supplying these transfer mediums to the image carrier; and post card supplying means, having a manual feeding section for manually feeding transfer mediums, for holding post cards in a parallel manner in the manual feeding section, picking up these parallel post cards and supplying the parallel post cards to the image carrier.

7. An image forming apparatus comprising:

an image carrier for carrying an electrostatic latent image;

an image forming means for forming the latent image on the image carrier;

developing means for supplying a developing agent to the latent image formed by the image forming means and developing the latent image;

transfer means for allowing a developing agent image which is developed by the developing means to be transferred to a transfer medium;

supplying means for supplying the transfer medium to the image carrier; and control means for allowing a plurality of electrostatic latent images to be formed in a parallel array on the image carrier as required through the image forming means, wherein the supplying means has a holding section for, when a plurality of electrostatic latent images are formed in a parallel array at a time, holding the transfer medium in a parallel sheet array and, when the electrostatic latent image is formed as a single image, holding the transfer medium in a single individual form, first and second supply sections for allowing the transfer medium which is held in a parallel sheet array in the holding section to be picked up in units of one sheet in a parallel array at a time and supplying these parallel sheets to the image carrier, and a third supply section for allowing the transfer medium which is held in a single individual form in the holding section to be picked up in a one-by-one way and supplying the single individual sheet to the image carrier.

8. An image forming apparatus comprising:

an image carrier for carrying an electrostatic latent image;

an image forming device for forming the electrostatic latent image on the image carrier;

a developing device for supplying a developing agent onto the electrostatic latent image formed by the image forming device and developing the latent image;

a transfer device for transferring a developing agent image developed by the developing device to a transfer medium;

a control device for allowing a plurality of electrostatic latent images to be formed at a time in a parallel manner on the image carrier through the image forming device as required;

a supplying device including a holding section for holding transfer mediums side by side as required, and a first supplying section and a second supplying section for allowing the transfer mediums, which are held in the holding section side by side, to be picked up in a parallel way at a time and supplying these transfer mediums to the image carrier; and an operating section for setting a number of transfer mediums to be supplied by the supplying device, wherein when an odd number is set, only one of the first and second supply sections of the supplying device is operated to allow a final transfer medium to be taken out.

* * * * *

UNITED STATES PATENT AND TRADEMARK OFFICE

CERTIFICATE OF CORRECTION

PATENT NO. : 6,349,193 B1
DATED : February 19, 2002
INVENTOR(S) : Moritoshi Matayoshi It is certified that error appears in the above-identified patent and that said Letters Patent is hereby corrected as shown below:

Title page,
Item [54], should read as follows:

-- IMAGE FORMING APPARATUS WHICH FORMS PARALLEL ELECTROSTATIC IMAGES AND SUPPLIES SHEETS FROM A PARALLEL SHEET ARRAY --.

Signed and Sealed this

Tenth Day of September, 2002

*Attest:*

*Attesting Officer*

JAMES E. ROGAN
*Director of the United States Patent and Trademark Office*